US005529641A

United States Patent [19]

Saka et al.

[11] Patent Number: 5,529,641

[45] Date of Patent: Jun. 25, 1996

[54] CAST IRON SLIDE MEMBER

[75] Inventors: Tsutomu Saka; Akira Fujiwara; Noriyuki Yamada, all of Wako, Japan

[73] Assignee: Honda Giken Kogyo Kabushiki Kaisha, Tokyo, Japan

[21] Appl. No.: 354,041

[22] Filed: Dec. 6, 1994

[30] Foreign Application Priority Data

Dec. 10, 1993 [JP] Japan ..... 5-310418

[51] Int. Cl.[6] ..... C22C 38/56

[52] U.S. Cl. ..... 148/323; 148/321; 420/17

[58] Field of Search ..... 420/17; 148/323, 148/321

[56] References Cited

FOREIGN PATENT DOCUMENTS

| | | | |
|---|---|---|---|
| 2245773 | 4/1975 | France . | |
| 4627135 | 8/1971 | Japan | 420/17 |
| 986954 | 1/1983 | U.S.S.R. | 420/17 |

OTHER PUBLICATIONS

Patent Abstracts of Japan vol. 3, No. 152 (C–067) 9 Oct. 1979 & JP–A–54 130 427 (Toyota Motor Corp) 9 Oct. 1979.

Database WPI Week 8340, Derwent Publications Ltd., London, GB; AN 83–780128 & JP–A–58 144 615 (Toyo Kogyo KK) 29 Aug. 1983.

Database WPI Week 7652, Derwent Publications Ltd., London, GB; AN 76–97598X & SU–A–508 556 (UKR Correspond Poly) 11 Jun. 1976.

Database WPI Week 9232, Derwent Publications Ltd., London, GB; AN 92–266687 & SU–A–1 687 641 (Chermetmekhanizatsiya Ferr Metal Mechn) 30 Oct. 1991.

Patent Abstracts of Japan vol. 10, No. 131 (C–346) 15 May 1986 & JP–A–60 258 417 (Honda Giken Kogyo KK) 20 Dec. 1985.

Database WPI Week 7710, Derwent Publications Ltd., London, GB; AN 77–16915Y & JP–A–50 090 521 (Toyota Motor KK) 19 Jul. 1975.

*Primary Examiner*—Deborah Yee

*Attorney, Agent, or Firm*—Nikaido, Marmelstein, Murray & Oram

[57] ABSTRACT

A cast iron slide member is formed from cast iron comprising 3.0% to 3.6% by weight of carbon (C), 1.6% to 2.4% by weight of silicon (Si), 0.2% to 1.5% by weight of manganese (Mn), 0.5% to 1.5% by weight of chromium (Cr), 1.5% to 3.0% by weight of nickel (Ni), 0.5% to 1.0% by weight of molybdenum (Mo), 0.0003% to 0.1% by weight of at least one chilling promoting element $E_L$ selected from the group consisting of bismuth (Bi), tellurium (Te) and cerium (Ce), and the balance of iron (Fe) and unavoidable impurities. The slide member has a chilled slide portion. Thus, it is possible to improve the scuffing and pitting resistances of the slide portion.

9 Claims, 2 Drawing Sheets

CAST IRON SLIDE MEMBER

BACKGROUND OF THE INVENTION

1. Field of the Invention

The present invention relates to a cast iron slide member, and particularly to a slide member for use under a high surface pressure.

2. Description of the Prior Art

A cast iron cam shaft for an internal combustion engine is conventionally known as such a slide member. The entire outer peripheral area, on the camshaft can be a slide portion, or a half of the outer peripheral area, including a nose portion, can be the slide portion. In either case, the entire slide portion of this structure is chilled.

When such a cam shaft is used under a high surface pressure, pitting and scuffing resistances of the nose portion becomes a problem.

In order to improve the pitting and scuffing resistances of this sliding portion, it is required that the chilled structure of the nose portion is a uniform fine structure having a large amount of precipitated free cementite. Such a structure has a high hardness. The hardness of the base structure is not reduced by a strain relief annealing conducted at a thermally treating temperature of 600° C. after casting.

SUMMARY OF THE INVENTION

Accordingly, it is an object of the present invention to provide a cast iron slide member of the type described above, which has a slide portion, wherein the above described requirements can be satisfied by utilizing a particular composition from which to form the cam shaft.

To achieve the above object, according to the present invention, there is provided a cast iron slide member which is formed from a cast iron composition comprising: 3.0% to 3.6% by weight of carbon (C), 1.6% to 2.4% by weight of silicon (Si), 0.2% to 1.5% by weight of manganese (Mn), 0.5% to 1.0% by weight of chromium (Cr), 1.5% to 3.0% by weight of nickel (Ni), 0.5% to 1.0% by weight of molybdenum (Mo), 0.003% to 0.1% by weight of at least one chilling promoting element $E_L$ selected from the group consisting of bismuth (Bi), tellurium (Te) and cerium (Ce), and the balance of iron (Fe) and unavoidable impurities; wherein said slide members include a chilled slide portion.

If the composition of the slide member is maintained in the above specified manner, the chilled structure of the slide portion is a uniform fine structure having a large amount of precipitated cementite which has a high hardness. In addition, the base structure is converted to martensite and is micronized. Hence, the hardness of the base structure can be reduced by a strain relief annealing process carried out at a thermal treating temperature of about 600° C. Thus, a slide member having excellent scuffing and pitting resistance can be produced.

The reasons why each of the chemical constituents is added and the reasons why the content of each chemical constituent is specified, are as follows.

Carbon (C) is used to enhance the castability of the slide member, to form a chilled structure in the slide portion and to improve the quality of the chilled structure. However, if the C content is smaller than 3.0% by weight, the flowability of the molten metal alloy is reduced. On the other hand, if the C content is larger than 3.6% by weight, there is a risk of graphite being precipitated, resulting in a degraded quality of the chilled structure.

Silicon (Si) is used to improve the quality of the chilled structure. However, if the Si content is smaller than 1.5% by weight, the depth of the chilled structure is increased, resulting in a slide member having a reduced deflection force. On the other hand, if the Si content is larger than 2.4% by weight, the depth of the chilled structure is reduced, because the silicon (Si) is a graphitization promoting element.

Manganese (Mn) is used to insure that the chilled structure has a sufficient depth to uniformly micronize the chilled structure and the base structure, and moreover to prevent the precipitation of graphite. However, if the Mn content is smaller than 0.2% by weight, the molten metal does not have a super-cooling capacity and, as a result, the depth of the chilled structure is reduced and the chilled structure and the base structure cannot be uniformly micronized. On the other hand, if the Mn content is larger than 1.5% by weight, the flowability of the molten metal is reduced.

Chromium (Cr) is used to increase the amount of free cementite precipitated in the structure, to improve the quality of the chilled structure, and to strengthen the base structure. However, if the Cr content is smaller than 0.5% by weight, the amount of precipitated free cementite is reduced to an extent that it fails to strengthen the base structure. On the other hand, if the Cr content is larger than 1.5% by weight, the chilling is attained over the entire outer peripheral area, resulting in a reduced deflection force and a degraded machinability, because chromium (Cr) has the effect of promoting chilling.

Nickel (Ni) is used to encourage conversion to martensite and to strengthen the base structure. However, if the Ni content is smaller than 1.0% by weight, the base structure cannot become martensite. On the other hand, if the Ni content is larger than 3.0% by weight, the workability of the slide member is degraded and, for example, cracks may be produced in the slide member during working thereof.

Molybdenum (Mo) is used to increase the strength of free cementite, to improve the quality of the chilled structure and to strengthen the base structure. However, if the Mo content is smaller than 0.5% by weight, the free cementite and the base structure cannot be sufficiently strengthened. On the other hand, if the Mo content is larger than 1.0% by weight, the chilling is attained over the entire outer peripheral areas, resulting in a reduced deflection force and a degraded machinability, because molybdenum (Mo) has an effect of promoting chilling, as does chromium.

Bismuth, tellurium and cerium are chilling promoting elements $E_L$. They are used to contribute to the formation of a chilled structure, to uniformly micronize the chilled structure and to inhibit the precipitation of graphite. At least one chill-promoting element $E_L$ selected from these elements is added. Therefore, if two or more the chilling promoting elements $E_L$ are added, the total amount thereof is determined in a range of 0.0003% (inclusive) to 0.1% (inclusive) by weight. If the $E_L$ content is smaller than 0.0003% by weight, the effect of addition of the chilling promoting element $E_L$ is lost. On the other hand, if the content of $E_L$ is larger than 0.1% by weight, chilling is attained over the entire outer peripheral area, and particularly the hardness of the inside portion of the slide member is excessively increased. As a result, it becomes difficult or even impossible to drill the slide member. Preferably, the content of the chilling promoting element $E_L$ is smaller than 0.001% by weight. If the $E_L$ content is equal to or larger than 0.001% by weight, the entire outer peripheral area of the slide member tends to be chilled.

The above and other objects, features and advantages of the invention will become apparent from the following description of a preferred embodiment taken in conjunction with the accompanying drawings.

DESCRIPTION OF THE PREFERRED EMBODIMENT

Figure 1:
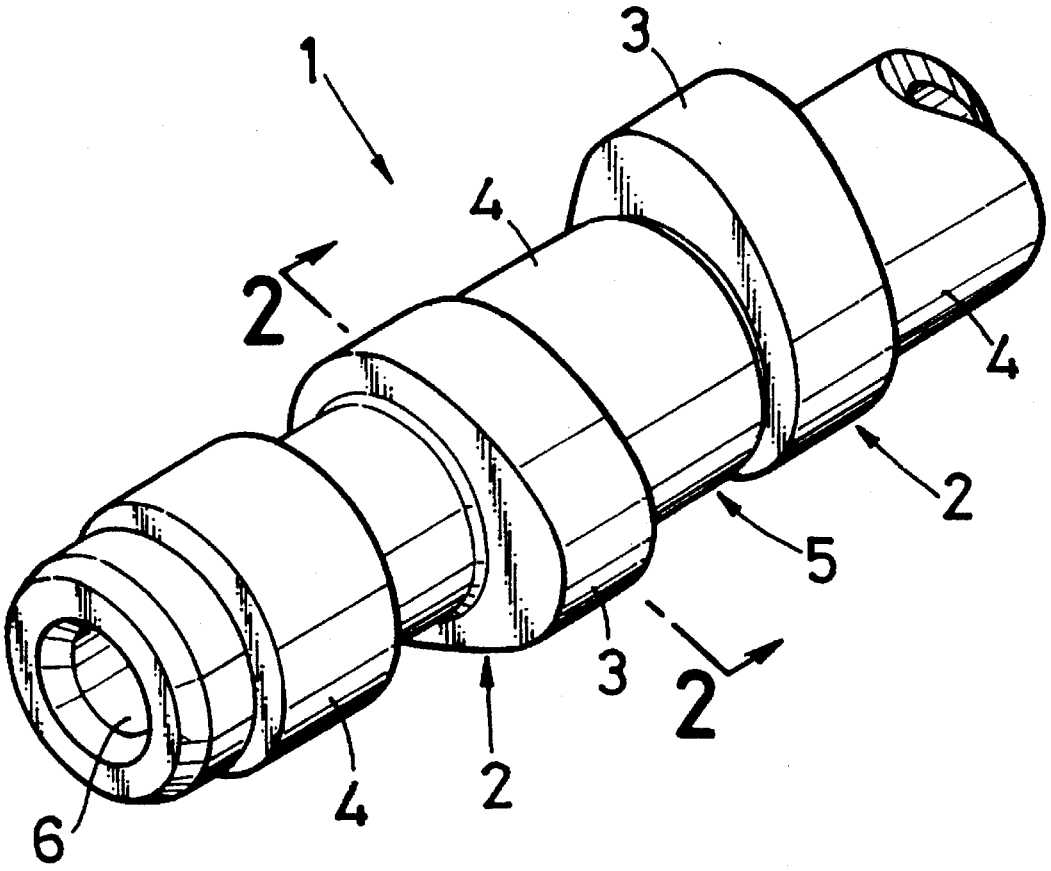
FIG. 1 is a perspective view of an essential portion of a cam shaft.
Figure 2:
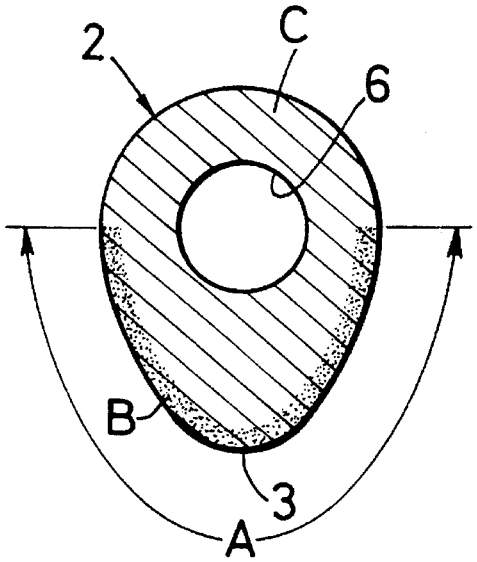
FIG. 2 is a sectional view taken along a line 2—2 in FIG. 1; looking in the direction of the arrows.

FIGS. 1 and 2 show a cam shaft 1 made of cast iron for use in an internal combustion engine as a slide member. The cam shaft 1 has a partial outer peripheral area A, including nose portions 3 of cams 2, which constitute its slide portions. The partial outer peripheral area A has been chilled and therefore, each of the cams 2 has a chilled structure B. Most of the area C of each of the cams 2, excluding the outer semi-peripheral areas A and a shaft portion 5 including a journal portion 4, are not chilled. In FIGS. 1 and 2, reference character 6 is an oil hole.

The cam shaft 1 in this embodiment is formed from cast iron which contains 3.0% (inclusive) to 3.6% (inclusive) by weight of carbon (C), 1.6% (inclusive) to 2.4% (inclusive) by weight of silicon (Si), 0.2% (inclusive) to 1.5% (inclusive) by weight of manganese (Mn), 0.5% (inclusive) to 1.5% (inclusive) by weight of chromium (Cr), 1.0% (inclusive) to 3.0% (inclusive) by weight of nickel (Ni), 0.5% (inclusive) to 1.0% (inclusive) by weight of molybdenum (Mo), 0.0003% (inclusive) to 0.1% (inclusive) by weight of at least one chilling promoting element $E_L$ selected from the group consisting of bismuth (Bi), tellurium (Te) and cerium (Ce), and the balance of iron (Fe) and unavoidable impurities.

Figure 3:
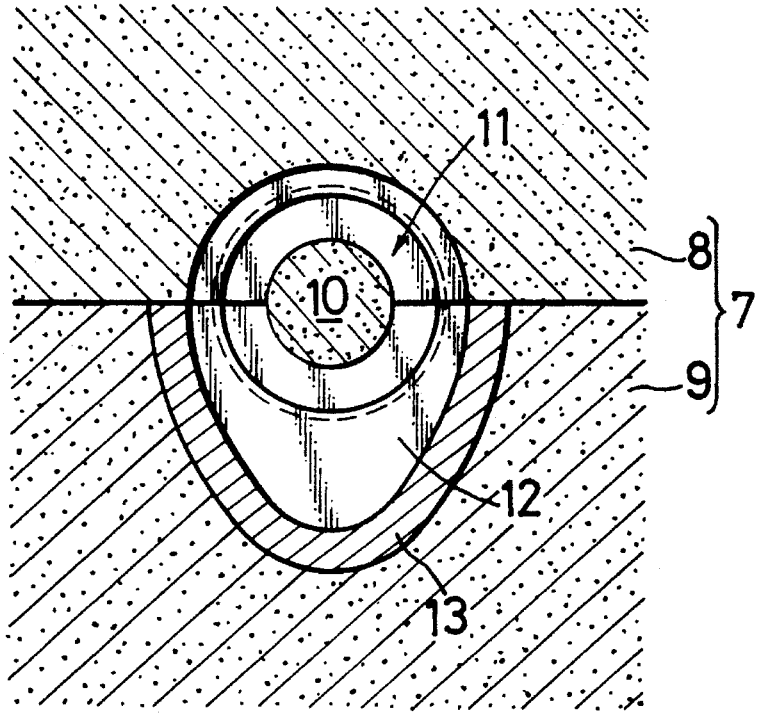
FIG. 3 is a sectional view of an essential portion of a casting mold.

Such cam shaft 1 is cast using a casting mold 7 shown in FIG. 3. The casting mold 7 includes an upper die 8, a lower die 9, and an oil hole shaping core 10 which is clamped between the upper and lower dies 8 and 9 by closing the upper and lower dies 8 and 9. A cam shaft molding cavity 11 is defined around the core. A portion of the lower die 9 for molding the partial outer peripheral area A, including the nose portions 3 in a cam molding area 12 of the cavity 11, is formed from a Fe-based or Cu-based chiller 13.

A molten metal having a suitable cast iron composition is prepared and poured into the cavity 11, whereby a cam shaft 1 is cast. At the same time, the partial outer peripheral area A of the cam 2 is quenched and chilled by the chiller 13 to form a chilled structure B. After casting, the cam shaft 1 is subjected to a strain relief annealing treatment at a thermal treating temperature of about 600° C.

Table 1 shows the composition, the hardness of the nose portion 3, the structure of the nose portion 3, and the hardness of the shaft portion 5 of cam shafts 1 produced using bismuth (Bi) as the chilling promoting element $E_L$ in examples 1 to 3. In the column of Chemical Constituents in Table 1, the balance consists of Fe and unavoidable impurities. The same is true in subsequent Tables The term "chilled", in the column reporting the structure of the hose portion 3, means a uniform fine chilled structure. The same is true in the subsequent Tables.

TABLE 1

| | Chemical constituent (% by weight) | | | | | | | | | Nose portion | | Hardness of shaft portion | |
|---|---|---|---|---|---|---|---|---|---|---|---|---|---|
| | | | | | | | | | | hardness | | Surface | Interior |
| Example | C | Si | Mn | P | S | Cr | Ni | Mo | Bi | (HRC) | Structure | (HRC) | (HRC) |
| (1) | 3.3 | 2.01 | 1.02 | 0.065 | 0.056 | 0.85 | 2.06 | 0.80 | 0.00038 | 54 | chilled | 38 | 27 |
| (2) | 3.3 | 2.01 | 1.02 | 0.065 | 0.056 | 0.85 | 2.06 | 0.80 | 0.00060 | 55 | chilled | 39 | 32 |
| (3) | 3.2 | 2.01 | 1.02 | 0.065 | 0.056 | 0.85 | 2.06 | 0.80 | 0.00090 | 56 | chilled | 42 | 35 |

TABLE 2

| | Chemical constituent (% by weight) | | | | | | | | | Nose portion | | Hardness of shaft portion | |
|---|---|---|---|---|---|---|---|---|---|---|---|---|---|
| | | | | | | | | | | hardness | | Surface | Interior |
| Example | C | Si | Mn | P | S | Cr | Ni | Mo | Te | (HRC) | Structure | (HRC) | (HRC) |
| (4) | 3.22 | 2.04 | 1.02 | 0.043 | 0.10 | 0.85 | 2.06 | 0.76 | 0.00038 | 54.0~55.5 | chilled | 35 | 30 |
| (5) | 3.22 | 2.04 | 1.02 | 0.043 | 0.10 | 0.85 | 2.06 | 0.76 | 0.00098 | 57.0~58.0 | chilled | 40 | 35 |

Table 3 shows the composition, the hardness of the nose portion 3, the structure of the nose portion 3 and the hardness of the shaft portion 5 of cam shafts 1 produced using cerium (Ce), as the chilling promoting element $E_L$ in examples 6 and 7.

TABLE 3

| Example | Chemical constituent (% by weight) C | Si | Mn | P | S | Cr | Ni | Mo | Ce | Nose portion hardness (HRC) | Structure | Hardness of shaft portion Surface (HRC) | Interior (HRC) |
|---|---|---|---|---|---|---|---|---|---|---|---|---|---|
| (6) | 3.3 | 2.01 | 1.02 | 0.065 | 0.056 | 0.85 | 2.06 | 0.76 | 0.00030 | 55 | chilled | 38 | 30 |
| (7) | 3.3 | 2.01 | 1.02 | 0.065 | 0.056 | 0.85 | 2.06 | 0.76 | 0.00090 | 57 | chilled | 41 | 30 |

Table 4 shows the composition, the hardness of the nose portion 3, the structure of the nose portion 3 and the hardness of the shaft portion 5 of cam shafts 1 produced using two elements: tellurium (Te) and cerium (Ce), as the chilling promoting element $E_L$ in examples 8 and 9.

As shown in Tables 1 to 5, in the samples 1 to 11 of the cam shafts 1, wherein the content of each of the chemical constituents is controlled to be within the above-describe range, the hardness HRC of each nose portion 3 is equal to or greater than 54, and the structure of the nose portion 3 is

TABLE 4

| Example | Chemical constituent (% by weight) C | Si | Mn | P | S | Cr | Ni | Mo | Te, Ce | Nose portion hardness (HRC) | Structure | Hardness of shaft portion Surface (HRC) | Interior (HRC) |
|---|---|---|---|---|---|---|---|---|---|---|---|---|---|
| (8) | 3.3 | 2.01 | 1.02 | 0.065 | 0.056 | 0.85 | 2.06 | 0.76 | 0.00030 | 55 | chilled | 38 | 30 |
| (9) | 3.3 | 2.01 | 1.02 | 0.065 | 0.056 | 0.85 | 2.06 | 0.76 | 0.00090 | 56 | chilled | 45 | 34 |

Table 5 shows the composition, the hardness of the nose portion 3, the structure of the nose portion 3 and the hardness of the shaft portion 5 of cam shafts 1 produced using three elements: bismuth (Bi), tellurium (Te) and cerium (Ce) as the chilling promoting elements $E_L$ in examples 10 and 11.

a uniform fine chilled structure B. Moreover, the hardness HRC of the shaft portion 5 is maintained at a low level, as compared with the hardness of the nose portion 3.

As shown in Table 6, the chilled structure of the cam shafts made according to comparative examples 1 to 5 is

TABLE 5

| Example | Chemical constituent (% by weight) C | Si | Mn | P | S | Cr | Ni | Mo | Bi, Te, Ce | Nose portion hardness (HRC) | Structure | Hardness of shaft portion Surface (HRC) | Interior (HRC) |
|---|---|---|---|---|---|---|---|---|---|---|---|---|---|
| (10) | 3.3 | 2.01 | 1.02 | 0.065 | 0.056 | 0.85 | 2.06 | 0.76 | 0.00030 | 54 | chilled | 38 | 30 |
| (11) | 3.3 | 2.01 | 1.02 | 0.065 | 0.056 | 0.85 | 2.06 | 0.76 | 0.00098 | 57 | chilled | 46 | 35 |

Table 6 shows the composition, the hardness of the nose portion 3, the structure of the nose portion 3 and the hardness of the shaft portion 4 of cam shafts 1 produced using tellurium (Te) as the chilling promoting element $E_L$ for comparative examples 1 to 5.

micronized as a result of the containment of tellurium, but in the comparative examples 1 and 2, the base structure is not strengthened, because the Cr, Ni and Mo contents depart from the above-described ranges. Therefore, the hardness HRC of the nose portion of the cams is non-uniform.

TABLE 6

| Comparative Example | Chemical constituent (% by weight) C | Si | Mn | P | S | Cr | Ni | Mo | Te | Nose portion hardness (HRC) | Structure | Hardness of shaft portion Surface (HRC) | Interior (HRC) |
|---|---|---|---|---|---|---|---|---|---|---|---|---|---|
| (1) | 3.22 | 2.04 | 0.71 | 0.043 | 0.10 | 0.38 | 0.41 | — | 0.15 | 51.0~54.0 | chilled | 54 | 54 |
| (2) | 3.22 | 2.04 | 0.71 | 0.043 | 0.10 | 0.38 | 0.41 | 0.25 | 0.005 | 51.0~54.0 | chilled | 53 | 41 |
| (3) | 3.22 | 2.04 | 0.71 | 0.043 | 0.10 | 0.93 | 0.45 | 0.35 | 0.00038 | 51.5~53.5 | chilled | 43 | 35 |
| (4) | 3.22 | 2.04 | 0.71 | 0.043 | 0.10 | 0.93 | 0.45 | 0.35 | 0.00067 | 52.0~53.0 | chilled | 30 | 25 |
| (5) | 3.22 | 2.04 | 0.71 | 0.043 | 0.10 | 0.78 | 1.0 | 0.40 | 0.00038 | 51.5~53.5 | chilled | 30 | 25 |

Further, the entire outer peripheral areas of the cam shaft 1 tends to be chilled, because the Te content is relatively large.

Because the Ni and Mo contents in comparative examples 3 and 4 depart from the above-described ranges, and the Mo content in comparative example 5 departs from the above-described range, the base structure is not strengthened and therefore the hardness HRC of the nose portion is not uniform and is reduced.

The cam shaft 1 of example 5 was incorporated into a valve operating system in an engine to examine the sliding characteristics of the cam 2. The valve operating system used was a slipper type valve operating system having a cam slide portion of a rocker arm formed by a slipper surface forming piece, and a roller type valve operating system having a roller used in place of the slipper surface forming piece.

The slipping forming piece was formed from cast iron consisting of 2.4% by weight of carbon (C), 0.8% by weight of silicon (Si), 0.5% by weight of phosphorus (P), 0.3% by weight of manganese (Mn), 13% by weight of chromium, (Cr), 2.8% by weight of molybdenum (Mo), 0.13% by weight of tungsten (W), 0.13% by weight of vanadium (V), 1.4% by weight of nickel (Ni) and the balance of iron (Fe). The roller was formed from high-carbon chromium bearing steel (JIS SUJ2). The outer peripheral surface of each of the cams 2 was subjected to the same, known surface treatment, e.g., a steam treatment to improve its conformability to the rocker arm.

In the slipper type valve operating system, scuffing of each cam 2 becomes a problem. Therefore, the scuffing resistance of the nose portion 3 was examined by setting the number of revolutions of the engine at 4,300 rpm and varying the surface pressure of the cam 2 applied to the nose portion 3. The result showed that scuffing occurred in the nose portion 3 even under a very light surface pressure of 100 kgf/mm$^2$.

On the other hand, in the roller type valve operating system, pitting of each cam 2 is an issue. Therefore, the pitting resistance of the nose portion 3 was examined by setting the number of revolutions of the engine at 2,000 rpm and varying the surface pressure of the cam 2 applied to the nose portion 3. The result showed that pitting occurred in the nose portion 3 even under a low surface pressure of 180 kgf/mm$^2$.

It can be seen from these facts that the cam shaft 1 in example 5 exhibits excellent sliding characteristics under a high surface pressure.

Although the present invention has been described as being applied to the cam shaft, it will be understood that the present invention is not limited to a cam shaft and is, of course, applicable to other slide members.

What is claimed is:

1. An article comprising a slide surface portion comprising:

3.0% to 3.6% by weight of carbon (C), 1.6% to 2.4% by weight of silicon (Si), 0.2% to 1.5% by weight of manganese (Mn), 0.5% to 1.5% by weight of chromium (Cr), 1.0% to 3.0% by weight of nickel (Ni), 0.5% to 1.0% by weight of molybdenum (Mo), 0.0003% to 0.1% by weight of at least one chilling promoting element $E_L$ selected from the group consisting of bismuth (Bi), tellurium (Te) and cerium (Ce), and a balance of iron (Fe) together with unavoidable impurities.

2. A cast iron slide member according to claim 1, wherein said chilling promoting element $E_L$ is present in a proportion less than 0.001% by weight.

3. An article as claimed in claim 1 wherein said surface portion has a surface which has been chilled.

4. An article as claimed in claim 2 wherein said surface portion has a surface which has been chilled.

5. A cam assembly, suitable for use in an internal combustion engine, comprising a cam shaft having a cam disposed thereon, wherein said cam comprises a nose portion which has been chilled.

6. A cam assembly, suitable for use in an internal combustion engine, comprising a cam shaft having a cam disposed thereon, wherein said cam comprises a nose portion comprising an alloy comprising: 3.0 to 3.6% by weight of carbon (C), 1.6 to 2.4% by weight silicon (Si), 0.2 to 1.5% by weight manganese (Mn), 0.5 to 1.5% by weight chromium (Cr), 1.5 to 3.0% by weight molybdenum (Mo), 0.003 to 0.1% by weight of at least one chilling promoting element selected from the group consisting of bismuth (Bi), tellurium (Te), and cerium (Ce), the remainder iron together with unavoidable impurities, and wherein said nose portion of said cam has been chilled.

7. A cam assembly as claimed in claim 6 wherein said chilling promoting element is present in a proportion of less than 0.001% by weight.

8. A cam assembly as claimed in claim 6 wherein said alloy consists essentially of said elements in said proportions.

9. A cam assembly as claimed in claim 7 wherein said alloy consists essentially of said elements in said proportions.

* * * * *